US007432945B2

(12) United States Patent
Kobayashi

(10) Patent No.: US 7,432,945 B2
(45) Date of Patent: Oct. 7, 2008

(54) EXPOSURE APPARATUS AND IMAGE FORMING APPARATUS

(75) Inventor: Hidekazu Kobayashi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 245 days.

(21) Appl. No.: 11/290,571

(22) Filed: Dec. 1, 2005

(65) Prior Publication Data

US 2006/0146117 A1 Jul. 6, 2006

(30) Foreign Application Priority Data

Jan. 4, 2005 (JP) ..... 2005-000084

(51) Int. Cl.
*B41J 2/45* (2006.01)

(52) U.S. Cl. ..... 347/238

(58) Field of Classification Search ..... 347/241, 347/237–238, 247

See application file for complete search history.

(56) References Cited

U.S. PATENT DOCUMENTS 4,314,261 A * 2/1982 Martinage ..... 347/251
4,746,935 A * 5/1988 Allen ..... 347/15
4,775,896 A * 10/1988 Umeda et al. ..... 347/248
2004/0125196 A1 * 7/2004 Nomura et al. ..... 347/236

FOREIGN PATENT DOCUMENTS

| | | |
|---|---|---|
| JP | 05-221021 | 8/1993 |
| JP | A-2003-054035 | 2/2003 |
| JP | 2003-341140 | 12/2003 |

* cited by examiner

*Primary Examiner*—Hai C Pham
(74) *Attorney, Agent, or Firm*—Oliff & Berridge, PLC

(57) ABSTRACT

An exposure apparatus includes a line head and a rotatable photosensitive drum, which is exposed by light from the line head. The line head includes N ("N" being 2 or greater) EL element column. In each EL element column, the area S of a light-emitting pixel of the EL element is constant within a corresponding column. When the column number of the EL element columns is from 1 to N, the area of the light-emitting pixel of the EL element in each column is $S_i=S_1/(2^{n-1})$ (where, "i" is the column number of each EL element column and a natural number from 1 to N, and "$S_1$" is the area of the light-emitting pixel of the EL element of a first column). One or more EL elements selected from N EL elements within the N EL element columns perform exposure on the same unit drawing region on the photosensitive drum.

10 Claims, 10 Drawing Sheets

EXPOSURE APPARATUS AND IMAGE FORMING APPARATUS

BACKGROUND

1. Technical Field

The present invention relates to an exposure apparatus and to an image forming apparatus including the exposure apparatus.

2. Related Art

Printers employing an electrophotographic method generally include line printers (an image forming apparatus). The line printers include a charging unit, a line printer head (a line head), a developing device, a transfer device and the like, which are closely disposed on a circumferential surface of a photosensitive drum, i.e., a subject part to be exposed. That is, exposure is performed on the photosensitive drum, which is charged by the charging unit, by selectively emitting light from a light-emitting element provided in the printer head to form an electrostatic latent image. The latent image is then developed using the toner supplied from the developing device. The transfer device transfers the toner image onto the paper.

Inorganic or organic light emitting diodes (LED) of two columns, which are arranged in a zigzag pattern, are used as the light-emitting elements of the above-described printer head. However, it is very difficult to arrange several thousands of light-emitting points with high precision. For this reason, there has recently been proposed an image forming apparatus including a light-emitting element array, in which an organic electroluminescent (organic EL) device having light-emitting points formed with high precision is used as the light-emitting element, as the printer head.

However, the organic EL element has a very low luminance as compared with an inorganic LED, etc. In the line head using the organic EL element as the light-emitting element, it is very difficult to obtain the sufficient amount of light (luminance) required for exposure.

Under this background, a technique in which so-called "multiple exposure" is performed, in which one-line printing is executed by performing one-line exposure on the photosensitive drum using a plurality of light-emitting lines (e.g., see JP-A-2003-341140)

In the above-mentioned multiple exposure technique, however, when gray-scale levels are displayed, it is essential to perform multistage gray-scale level control per pixel (one line) in terms of its structure. Therefore, since a clock frequency for every line is twice or higher than the number of gray-scale levels, this exceeds the response speed of an active element such as a thin film transistor (TFT). As a result, a driver for driving each EL element cannot be internally mounted on the substrate. This necessitates an external mounting driver. Therefore, the degree of freedom not only in manufacturing the line head (printer head), but also in terms of the structure of an exposure apparatus or an image forming apparatus including such external mounting driver is limited.

SUMMARY

An advantage of some aspects of the invention is that it provides an exposure apparatus in which gray-scale level can be easily displayed, a driving element for internal mounting can be used as a driver, the light amount necessary for exposure can be obtained and the lifespan of each line is almost the same, and an image forming apparatus including the exposure apparatus.

An exposure apparatus according to an aspect of the invention includes a line head in which a plurality of EL elements are aligned with each other and a rotatable photosensitive drum, which is exposed by light from the line head. The line head includes N (where, "N" is 2 or greater) EL element columns in which the alignment direction of the EL elements is parallel to the rotational axis of the photosensitive drum. In each of the EL element columns, the area of a light-emitting pixel of the EL element which emits light is constant within a corresponding column. When the column number of the EL element columns is from 1 to N, the area S of the light-emitting pixel of the EL element in each of the columns is $S^i=S_1\times 2^{i-1}$ (where, "i" is the column number of each of the EL element columns and a natural number from 1 to N, and "$S_1$" is the area of the light-emitting pixel of the EL element of a first column). One or a plurality of EL elements selected from N EL elements within the N EL element columns perform exposure on the same unit drawing region on the photosensitive drum.

In accordance with the exposure apparatus of the invention, one or a plurality of the N EL elements within the N columns of EL element columns is constructed to perform exposure the same unit drawing region on the photosensitive drum. For example, if each of the EL element has its gray-scale level controlled according to a binary value of lighting and non-lighting and a gray-scale level indicating the degree of exposure is varied depending on one of the N EL elements selected in order to perform exposure, gray-scale level with the number represented by the power of 2 can be easily displayed.

In other words, the exposure amount by each EL element is dependent on the area of each light-emitting pixel and is proportional thereto when luminance within the pixel is constant among the EL elements. In addition, in the exposure apparatus, if the area S of the light-emitting pixel of the EL element in each column is $S_i=S_1\times 2^{i-1}$ as described above and one or more of the N EL elements are properly selected as mentioned above, the sum of the areas of the light-emitting pixel of the selected EL element(s) can be changed in equal distance (equal difference) from $S_1$ to $S_1\times(2^N-1)$. Therefore, gray-scale level indicating the degree of exposure can be easily and satisfactorily displayed in such a way that exposure is performed by changing the emission area in equal distance (equal difference) as described above.

Furthermore, a gray-scale level of each of the EL elements is controlled according to a binary value of lighting and non-lighting as described above, the entire gray-scale level can be easily displayed. Accordingly, a clock frequency necessary for every line (one EL element column) decreases and a driver for driving each EL element can be internally mounted on the substrate.

Furthermore, each of the EL elements can obtain a necessary light amount since a plurality of EL elements performs exposure on the same unit drawing region although one EL element cannot obtain sufficient luminance (light amount).

In addition, in each EL element column, each EL element can make luminance within its pixel constant between the EL elements. The lifespan between the EL element columns becomes almost the same.

In addition, if each EL element is constructed to drive a driving element internally mounted on the substrate in which a corresponding EL element is formed, the degree of freedom not only in manufacturing the line head, but also in terms of the structure of an exposure apparatus or an image forming apparatus including this internal mounting driving element can be enhanced.

Furthermore, the photosensitive drum has the sensitivity having linearity between the lowest gray-scale level and the highest gray-scale level, in gray-scale levels indicating the degree of exposure for the unit drawing region of the photosensitive drum.

This obviates the need for providing a correction circuit and electrically correcting the sensitivity. Therefore, the structure of an apparatus can be simplified and luminance within a pixel of each EL element can be kept constant among EL elements.

Furthermore, in the exposure apparatus, the area S of the light-emitting pixel of the organic EL element, which is necessary to obtain the light amount with a value which is obtained by dividing the light amount necessary to obtain the highest gray-scale level in gray-scale levels indicating the degree of exposure for the unit drawing region of the photosensitive drum by $(2^N-1)$ (where, "N" is the number of EL element columns), is set to $S_1$.

By doing so, the light amount up to the highest gray-scale level can be surely obtained in equal distance (equal difference).

Furthermore, the exposure apparatus further include EL element columns of a group B, which includes each of the EL element columns as a group A and have the same number of EL element columns as a corresponding group A. These EL element columns have the same number of EL elements as each of the EL element columns of the group A and a relative location relation between the EL elements is the same as the group A. The EL element columns of the group A and the EL element columns of the group B are disposed at positions deviated by half of a distance therebetween from each other. The EL elements, each constituting the EL element columns of the group A and the EL element columns of the group B, are also disposed at positions deviated by half of a distance therebetween from each other.

If the EL element columns of the group A and the EL element columns of the group B are disposed at positions deviated by half of a distance therebetween from each other, as described above, the EL element columns in this group A alternately perform exposure on the same unit drawing region column in the EL element columns of the group B, which correspond to the EL element columns. This results in increased resolution of the image forming apparatus having the exposure apparatus.

Furthermore, in the exposure apparatus, the EL element columns of the group A and the EL element columns of the group B, which correspond to the EL element columns, are constructed to alternately perform exposure on the same unit drawing region column, and the EL element columns of the group A and the EL element column of the group B, which correspond to the EL element columns, have the same emission area of the light-emitting pixel; and also have the same line scanning sequence in each group.

By doing so, driving control of each EL element column can be simplified and facilitated. This simplifies a control circuit itself.

Furthermore, in the exposure apparatus, the N EL elements among the N EL element columns performs multiple exposure in which the same unit drawing region is at least partially overlapped, and has the highest degree of overlapping in the multiple exposure, which is less than N, i.e., the number of EL element columns.

The sensitivity of the photosensitive drum is decided by the exposure amount (exposure intensity) upon exposure by the EL element, and the amount of removed electricity, in which how much has the amount, which has been previously charged by the photosensitive drum, been removed. A sensitivity characteristic of the photosensitive drum has lower linearity as the degree of multiple exposure is increased when the multiple exposure is performed on the same drawing point. Therefore, although multiple exposure is performed with it being at least partially overlapped as mentioned above, the linearity of a sensitivity characteristic in the photosensitive drum can be prevented from lowering by making the maximum overlapping degree in the multiple exposure less than N, i.e., the number of EL element columns.

Furthermore, in the exposure apparatus, in the N number of corresponding EL elements among the N column of EL element columns, the regions that are exposed in the same unit drawing region do not overlap.

By doing so, the linearity of a sensitivity characteristic in the photosensitive drum can be surely prevented from lowering by not performing multiple exposure.

In addition, in the exposure apparatus, the EL elements are organic EL elements.

The image forming apparatus of the invention includes an exposure apparatus as exposure means.

In accordance with the image forming apparatus, as mentioned above, gray-scale level representation can be performed conveniently and excellently. Furthermore, since a line head that is internally mounted on the substrate can be used as a driver for driving each EL element, the degree of freedom in terms of the structure of the image forming apparatus including the line head is increased. In addition, since a line head in which a necessary light amount has been obtained is employed, a sufficient degree of gray-scale levels can be achieved. Furthermore, the lifespan of the line head is almost the same among EL element columns. Therefore, the lifespan of the entire line head can be increased and the shortening of the lifespan of an image forming apparatus itself, which may be incurred by the line head, can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
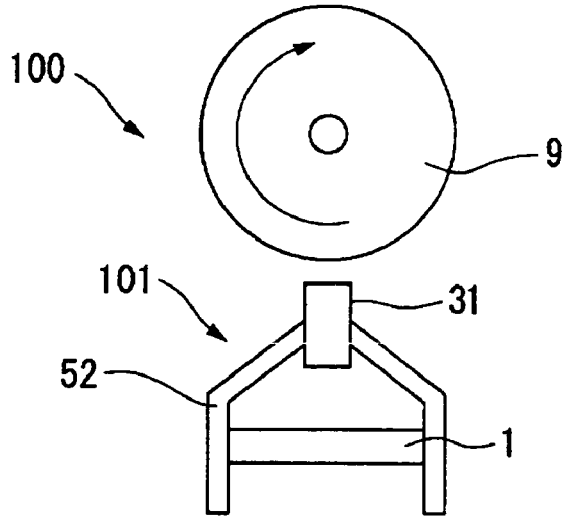
FIG. 1 is a diagram showing the construction of an exposure apparatus according to an embodiment of the invention.

Embodiments of the invention will now be described in detail with reference to the accompanying drawings. In addition, in the drawings which are used as a reference, the size of each member is adjusted in order to have a recognizable size in the drawings.

Exposure Apparatus

An exposure apparatus according to the invention will be first described.

FIG. 1 shows the construction of the exposure apparatus according to an embodiment of the invention. In FIG. 1, reference numeral 100 represents the exposure apparatus. The exposure apparatus 100 is used as exposure means in an image forming apparatus to be described later. The exposure apparatus 100 includes a line head 1, a lens array (an optical image forming system) 31 for forming images using light from the line head 1, and a photosensitive drum 9, which is exposed to light from the line head 1 which has transmitted through the lens array 31.

Line Head Module

Figure 2:
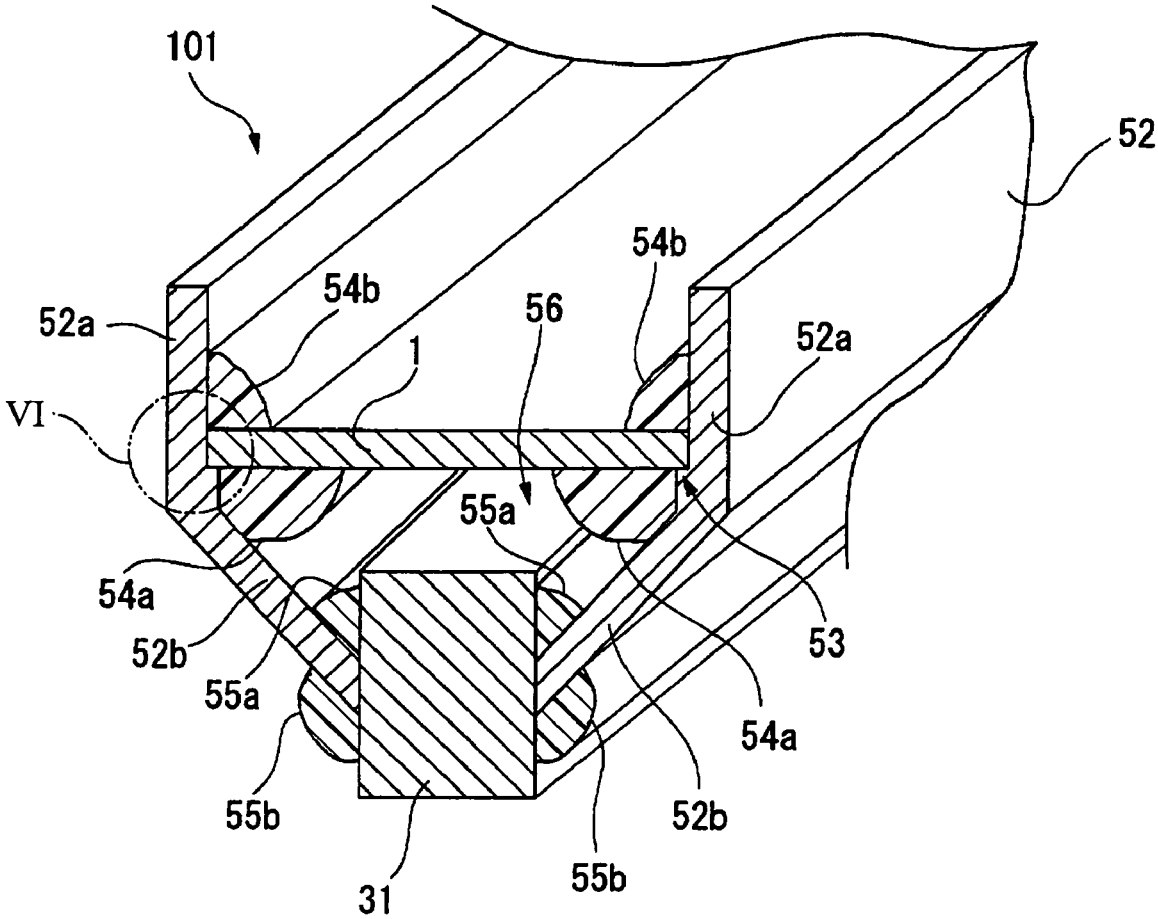
FIG. 2 is a perspective sectional view of a line head module according to an embodiment.

The line head 1 and the lens array 31 are aligned with each other and then integrally supported by a head case 52 to form a line head module 101. FIG. 2 is a perspective sectional view of the line head module 101. As shown in FIG. 2, the line head module 101 includes the line head 1 in which a plurality of organic EL elements are aligned, the lens array 31 in which a lens for forming images using light emitted from the line head 1 is disposed, and the head case 52 that supports an outer circumference of the line head 1 and the lens array 31. In the present embodiment, the SELFOC (registered trademark) lens array (Trademark of Nippon Sheet Glass Co., Ltd.: hereinafter, SELFOC (registered trademark) lens will be referred to as an "SL" and SELFOC (registered trademark) lens array will be referred to as an "SL array"), i.e., an erecting and unmagnifying imaging system is used as the lens array 31. Under this construction, the line head module 101 is adapted to form an erected and unmagnified image using light radiated from the line head 1 on the photosensitive drum 9.

Line Head

Figure 3:
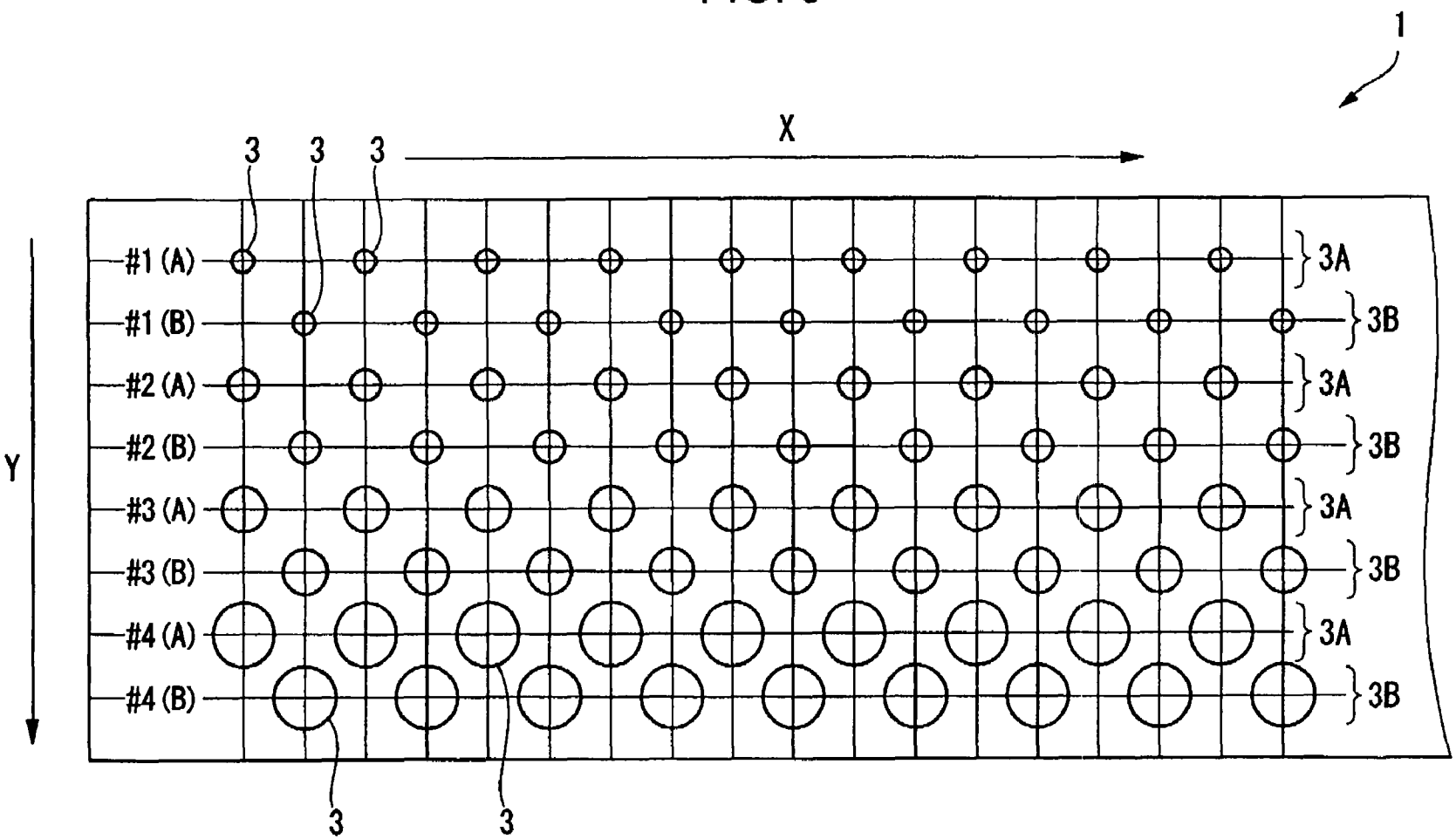
FIG. 3 diagrammatically shows a light emitting surface of the line head.

FIG. 3 diagrammatically shows the line head 1. The line head 1 includes a plurality of light-emitting element columns (EL element columns) in which a plurality of organic EL elements 3 is arranged on a rectangular element substrate 2, which is slim and long. In the present embodiment, the EL element columns include a 2 system of a group A and a group B, i.e., EL element columns 3A and EL element columns 3B. In addition, though not shown in FIG. 3, in the line head 1, a driving element group having a TFT for driving each organic EL element 3 is formed on the substrate in which the EL elements 3 are formed. A driving circuit for controlling the driving of the TFT (the driving element) is also integrated within the line head 1. Under this construction, the line head 1 has the driver mounted therein.

A light output plane of the line head 1 is disposed opposite to the photosensitive drum 9, as shown in FIG. 1. A column direction of each of the EL element columns 3A, 3B (a direction where the organic EL elements 3 are arranged) is parallel to the rotation axis of the photosensitive drum 9. Furthermore, in the present embodiment, the EL element columns 3A, 3B have four columns, respectively, as shown in FIG. 3. In the EL element columns 3A of the group A, assuming that a direction where the organic EL elements 3 are arrayed is an X-axis direction (X coordinates) and a direction where the respective columns are parallel is a Y-axis direction (Y coordinates) in each column, a pitch between the columns (a distance between the centers of the columns), i.e., a pitch in the Y-axis direction is constant in each EL element column 3A. In the organic EL elements 3 respectively constituting the EL element columns 3A, a pitch between elements (a distance between the centers), i.e., a pitch in the X-axis direction is also constant.

The EL element columns 3B of the group B have the same number as the EL element columns 3A of the group A. These EL element columns 3B have the same number of the EL elements 3 as the EL element columns 3A of the group A. In addition, a relative location relation between the EL elements 3 of the group B is the same as those of the group A. Furthermore, the EL element columns 3B of the group B are disposed with them being deviated about half pitch from the EL element columns 3A of the group A in the Y-axis direction. These EL elements 3 constituting each of the EL element columns 3B of the group B are also disposed with them being deviated about half pitch from the EL elements 3 constituting each of the EL element columns 3A of the group A. In this construction, the EL element columns 3A of the group A, which are disposed as odd-numbered columns, and the EL element columns 3B of the group B, which are disposed as even-numbered columns, in the Y-axis direction of FIG. 3, are disposed between neighboring columns in a zigzag pattern.

In addition, in the present embodiment, the numbers of the EL element columns 3A of the group A are #1(A), #2(A), #3(A) and #4(A) along the Y-axis direction, as shown in FIG. 3. Likewise, the numbers of the EL element columns 3B of the group B are #1(B), #2(B), #3(B) and #4(B).

Furthermore, in the present embodiment, the areas of light-emitting pixels, which constitute the emission of the organic EL elements 3, in the respective EL element columns 3A, 3B are formed to be constant within a corresponding column on a column basis. However, the areas of the light-emitting pixels, which constitute the emission of the organic EL elements 3, can be formed to be different from each other between the respective columns.

That is, in each of the EL element columns 3A and 3B, the area S of a light-emitting pixel of the EL element 3 can be expressed in the following Equation 1.

$$S_i = S_1 \times 2^{i-1} \quad \ldots 3)$$

In Equation 1, "i" indicates the column number of each of the EL element columns 3A, 3B and "$S_1$" indicates the area of a light-emitting pixel of an EL element whose column number is 1 (#1), i.e., a first column. Furthermore, the column number of each of the EL element columns 3A, 3B is a numeric part in #1(A) to #4(A) and #1(B) to #4(B), i.e., from 1 to 4, more particularly, a numeral indicating the order of a smaller area. As a result, the area S of the light-emitting pixels of the EL elements 3 of #1(A) and #1(B), which are in the first column, is $S_1$ in accordance with Equation 1. The area S of the light-emitting pixels of the EL elements 3 of #2(A) and #2(B), which are in the second column, is $S_1 \times 2$ in accordance with Equation 1. The area S of the light-emitting pixels of the EL elements 3 of #3(A) and #3(B), which are in the third column, is $S_1 \times 4$ in accordance with Equation 1. The area S of the light-emitting pixels of the EL elements 3 of #4(A) and #4(B), which are in the fourth column, is $S_1 \times 8$ in accordance with Equation 1. Therefore, the area $S_1$ of the light-emitting pixel of the EL element of the first column becomes the unit area for each area of the light-emitting pixels.

In addition, under this construction, the EL element columns 3A of the group A, which have the same column number, and the EL element columns 3B of the group B, which have the same column number, are the same in the area of their light-emitting pixels. In the present embodiment, the EL element columns 3A of the group A and the EL element columns 3B of the group B, which have the same area of light-emitting pixels, as described above, form a pair, and are constructed to alternately perform exposure on the same unit drawing region column, as will be described later.

Furthermore, in accordance with the invention, in the group A and the group B, in the EL element columns 3A, 3B, each constituting each group, the organic EL elements 3 located at the same location in the X-axis direction of FIG. 3, i.e., the organic EL elements 3 disposed in the same row are the organic EL elements 3 that correspond to each other. That is, in the present embodiment, since the group A and the group B have four columns of the EL element columns 3A, 3B, respectively, a group of corresponding organic EL elements 3 in each group is comprised of these four organic EL elements 3.

Figure 4:
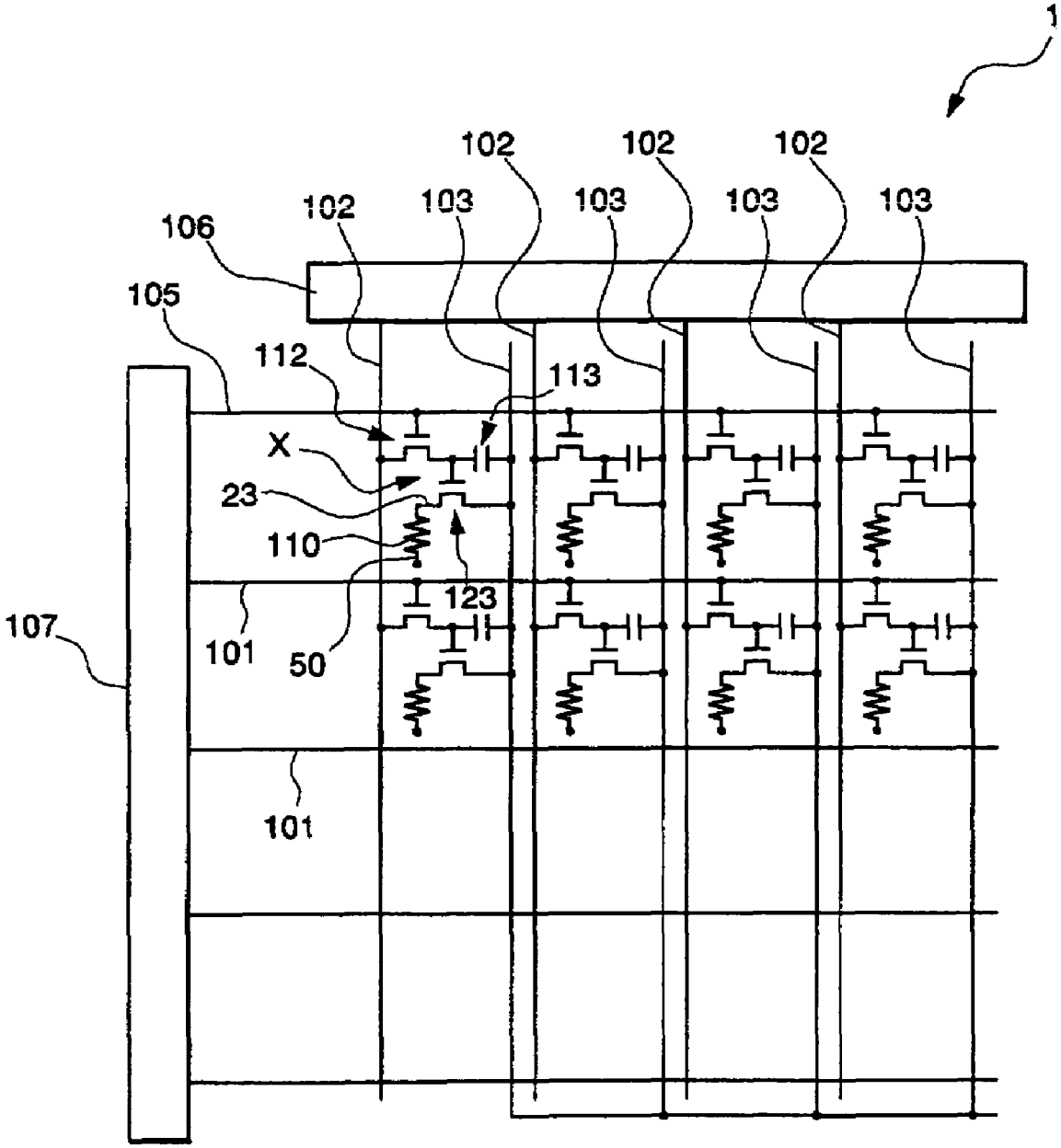
FIG. 4 shows a wiring structure of the line head.

Furthermore, the line head 1 is constructed such that each of the organic EL elements 3 is operated in an active matrix manner since the TFT is used as the switching element as shown in FIG. 4. That is, the line head 1 has a construction in which a plurality of scanning lines 105, . . . , a plurality of signal lines 102, . . . , which cross the scanning lines 105, respectively, and a plurality of power supply lines 103, . . . , which are parallel to the signal lines 102, respectively, are wired. The line head 1 further includes pixel regions X, . . . , which are provided at the intersections of the scanning lines 105, . . . and the signal lines 102, . . . .

A data line driving circuit 106 having a shift register, a level shifter, a video line and an analog switch is connected to the signal lines 102. Furthermore, a scanning line driving circuit 107 having a shift register and a level shifter are connected to the scanning lines 105. In the present embodiment, a driver having a TFT (a driving element) serving as a switching element, a driving circuit such as the data line driving circuit 106 and the scanning line driving circuit 107, and so on is formed on a substrate having the organic EL elements 3 formed thereon. The driver can be internally mounted.

Furthermore, each pixel region X includes a switching TFT 112 whose gate electrode is supplied with a scanning signal through the corresponding scanning line 105, a capacitor 113 for storing a pixel signal from the signal line 102 through the switching TFT 112, a driving TFT 123 whose gate electrode is supplied with the pixel signal that is stored by a corresponding storage capacitor 113, a pixel electrode 23 to which a driving current from a corresponding power supply line 103 is applied when being electrically connected to the power supply line 103 through the driving TFT 123, and a functional layer 110 interposed between the pixel electrode 23 and a cathode 50. The pixel electrode 23, the cathode 50 and the functional layer 110 constitute the organic EL element 3. In addition, the functional layer 110 includes a hole transport layer and a light-emitting layer, which will be described later.

In the line head 1 constructed as described above, when the scanning line 105 is driven to turn on the switching TFT 112, a potential of the signal line 102 is stored in the storage capacitor 113 and an on/off state of the driving TFT 123 is determined according to the state of a corresponding storage capacitor 113. Furthermore, the current flows from the power supply line 103 to the pixel electrode 23 through a channel of the driving TFT 123. The current flows into the cathode 50 via the functional layer 110. The functional layer 110 emits light according to the amount of the current flowing through them.

In addition, a detailed construction of the organic EL elements 3 and the driving element 4 will be described later. Even though the organic EL element 3 is used as the EL element in the line head 1, an inorganic EL element can be use instead of the organic EL element.

Furthermore, in the line head 1, since each of the organic EL elements 3 is driven in an active matrix manner, the respective corresponding organic EL elements 3, between the plurality of EL elements columns 3A and between the EL element columns 3B, performs exposure on the same unit drawing region on the photosensitive drum 9. Specifically, the photosensitive drum 9 rotates at the time of exposure and a unit drawing region on the photosensitive drum 9 is relatively moved in the Y-axis direction. Thereby, the four organic EL elements 3, which are disposed on the same row in each group and have the same location (X coordinates) in the X-axis direction, perform exposure on the same unit drawing region between the corresponding organic EL elements 3 as will be described later.

In the present embodiment, the shape of an aperture of a light-emitting pixel in each organic EL element 3 is circular as shown in FIG. 3. A central location of the aperture is identical to the intersection of virtual lines (actually, a scanning line and a signal line), which extend in a column direction (the X-axis direction) and a row direction (the Y-axis direction), respectively. Therefore, in the present embodiment, if exposure is performed on the same unit drawing region in corresponding four organic EL elements 3, a quadruple exposure can be performed on the photosensitive drum 9 as will be described later. In addition, in the present embodiment, each of the organic EL elements 3 has its gray-scale level controlled according to a binary value of lighting and non-lighting.

Furthermore, the luminance within each pixel in each organic EL element 3 is set to be constant. In general, in the organic EL element, the luminance is decided by the value of current flowing through the functional layer 110. The luminance is proportional to the current value in its usual range. Therefore, in the present embodiment, by controlling the flow of the current in proportion to the area of the light-emitting pixel in each of the EL element columns 3A, 3B having different light-emitting pixel areas, in each group, the luminance within each pixel can be made constant between the respective organic EL elements 3, as mentioned above.

In addition, the luminance within each pixel is constant between the respective organic EL elements 3 as described above and each of the organic EL elements 3 has its gray-scale level controlled according to a binary value of lighting and non-lighting. In addition, corresponding four organic EL elements 3 forming a group have the area having a multiplier, which is represented as the power of two with respect to the unit area ($S_1$) as expressed in Equation 1. Therefore, one or more of the four organic EL elements 3 constituting a group is selected and exposure is performed on the same unit drawing region on the photosensitive drum 9, as will be described later. Therefore, gray-scale levels represented by the power of two, i.e., 16 gray-scale levels (i.e., 2 to the 4th power) can be easily represented in the present embodiment.

Furthermore, the organic EL elements 3 of the group A and the organic EL elements 3 of the group B are disposed at positions deviated by half of a distance therebetween from each other. Therefore, as the EL element columns 3A, 3B having the same column number alternately performs exposure on the same unit drawing region column, it is possible to improve the resolution. Specifically, the apparent distance between the organic EL elements 3 in the X-axis direction becomes about a half of the distance between the elements in a single EL element column 3A or 3B, between the EL element columns 3A, 3B having the same column number. Since the distance between the organic EL elements 3 becomes smaller between the EL element columns 3A, 3B having the same column number, the resolution of the image forming apparatus to be described later can be improved.

SL Array

Figure 5:
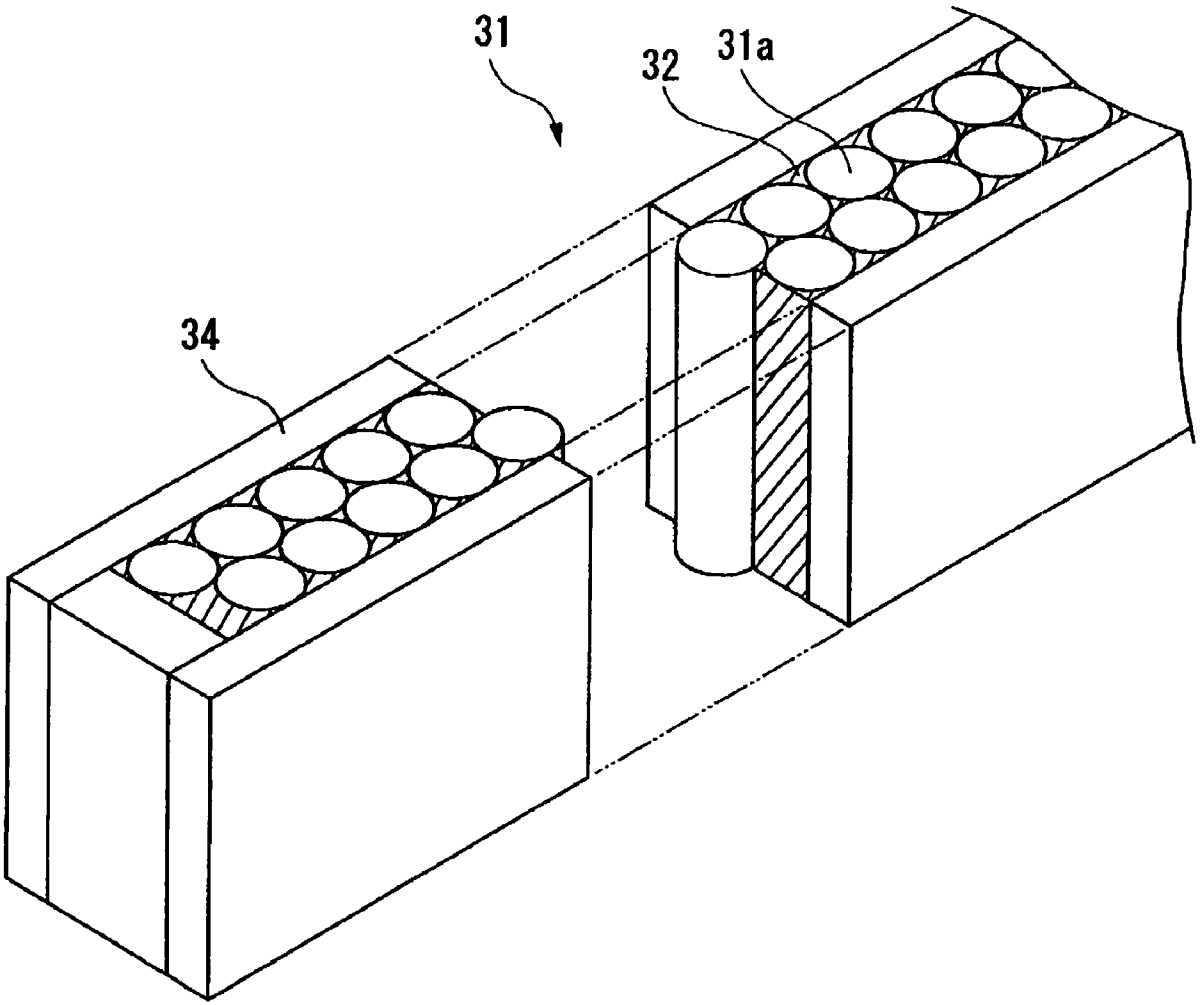
FIG. 5 is a perspective view of a SL array.

FIG. 5 is a perspective view of the SL array used as a lens array 31. The lens array 31 (SL array) includes SL elements 31*a*, which are arranged (disposed) as two columns in a zigzag pattern. Furthermore, gaps between the SL elements 31*a* disposed in a zigzag pattern are filled with a black silicon resin 32. Frames 34 are disposed around the SL elements 31*a* and the black silicon resin 32.

The SL elements 31*a* have the distribution of a refractive index, which describes a parabola extending from its center to its periphery. For this reason, light incident onto the SL elements 31*a* proceeds while meandering within the SL elements 31*a* at a constant cycle. Therefore, erected and unmagnified images can be formed by controlling the length of the SL elements 31*a*. In addition, in the SL elements 31*a* on which the erected and unmagnified images are formed as described above, the images formed by adjacent SL elements 31*a* can be overlapped with each other, leading to obtain various images. As a result, the lens array 31 shown in FIG. 5 can focus light emitted from the entire line head 1 with high accuracy.

Head Case

Returning to FIG. 2, the details of the line head module 101 will be described. The line head module 101 includes the head case 52 that supports the outer circumference of the line head 1 and the lens array 31. The head case 52 is formed of a rigid material, such as aluminum (Al), and has a slit shape. A cross-section vertical to a longitudinal direction of the head case 52 has opened upper and lower ends. Sidewalls 52*a*, 52*a* of the upper half part are parallel to each other and sidewalls 52*b*, 52*b* of the lower half part are inclined toward the center of the bottom. In addition, though not shown in the drawing, sidewalls on both sides in the longitudinal direction of the head case 52 are also parallel to each other.

Furthermore, the above-mentioned line head 1 is located within the sidewalls 52*a* on the upper half part of the head case 52.

Figure 6:
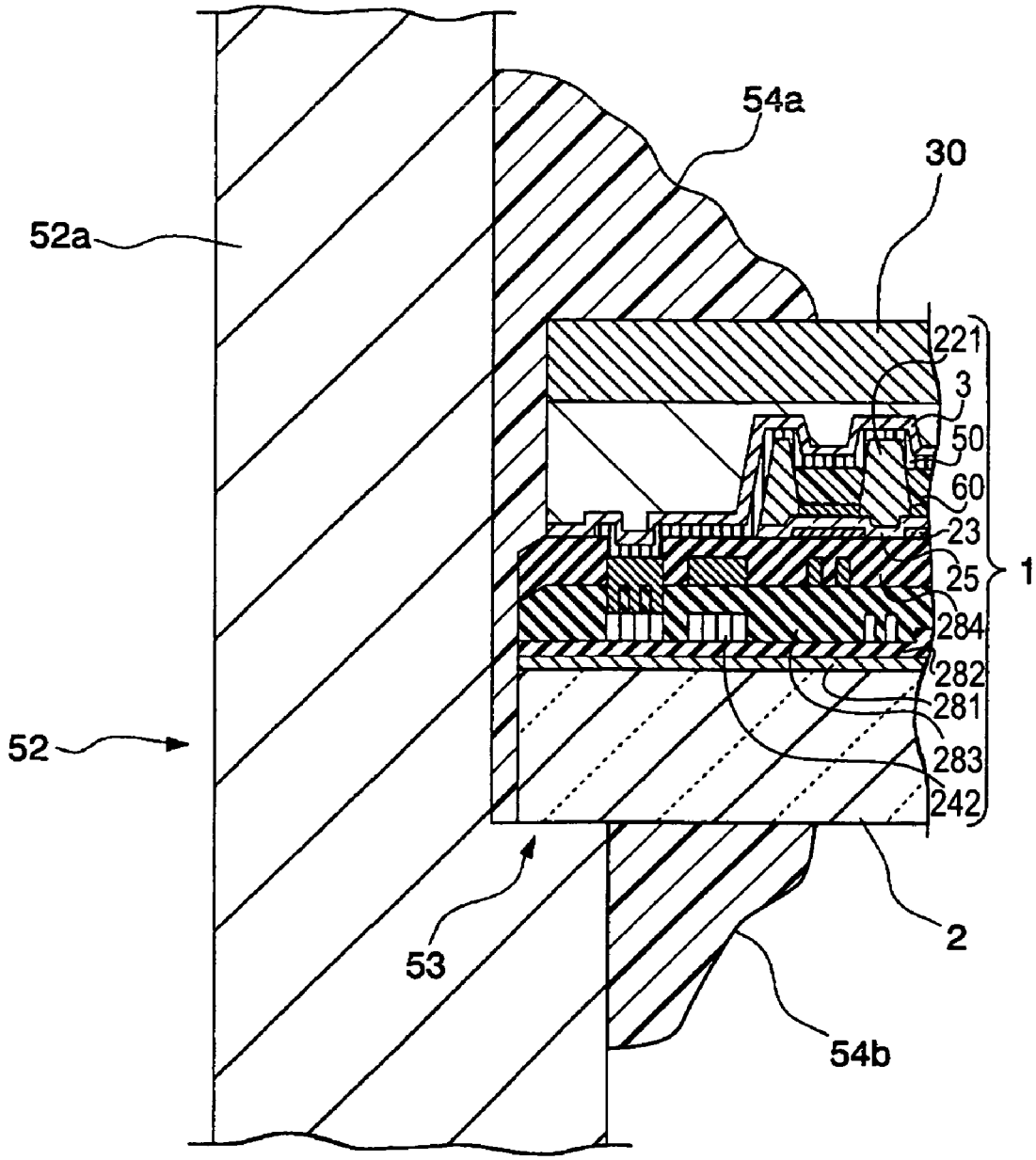
FIG. 6 is an enlarged view of the coupled portion of the line head.

FIG. 6 is an enlarged view of a coupled portion (a portion "IV" in FIG. 2) of the line head 1. As shown in FIG. 6, a step-type pedestal 53 is formed over the entire circumference of the inner surface of the sidewalls 52*a* of the head case 52. The line head 1 is arranged in a horizontal direction while the upper surface of the pedestal 53 abuts with a bottom surface of the line head 1. The line head 1 is a bottom emission type, which will be described in detail later. The element substrate 2 is disposed on the lower position and the sealing substrate 30 is disposed on the upper position.

Furthermore, sealants 54*a*, 54*b* are arranged over the entire circumference of corners formed by the sidewalls 52*a* of the head case 52 and the line head 1. In addition, other sealants are also filled in gaps between the inner surfaces of the sidewalls 52*a* of the head case 52 and the lateral side of the line head 1. Therefore, the line head 1 is air-tightly adhered to the head case 52. The sealant 54*b* adhered on the upper side of the line head 1 is formed of a ultraviolet curing resin such as acryl. Furthermore, the sealant 54*a* adhered on the lower side of the line head 1 is formed of a thermosetting resin such as an epoxy.

In addition, the sealants 54*a*, 54*b* can contain a getter agent. The getter agent refers to a drier or a deoxidizing agent, and functions to adsorb moisture or oxygen. In accordance with this construction, the sealants 54*a*, 54*b* can reliably prevent the permeability of moisture or oxygen. Therefore, since moisture absorption or oxidization of the organic EL elements formed in the line head can be prevented, the durability of the organic EL elements can be prevented from lowering and the life-span of the organic EL elements can be prevented from shortening.

Referring back to FIG. 2, the lens array 31 is disposed in the opening of a slit shape which is formed at the bottom end of the head case 52. Sealants 55*a*, 55*b* are arranged over the entire circumference of the corners formed by the sidewalls 52*b* of the head case 52 and the lens array 31. In addition, other sealants are also filled in gaps between the inner sides of the sidewalls 52*a* of the head case 52 and the lateral side of the line head 1. Therefore, the lens array 31 is air-tightly adhered to the head case 52. The sealant 55*a* disposed on the upper side of the lens array 31 is formed of a thermosetting resin such as an epoxy. Furthermore, the sealant 55*b* disposed on the lower side of the lens array 31 is formed of a ultraviolet curing resin such as acryl. Furthermore, these sealants 55*a*, 55*b* can contain a getter agent.

A chamber 56 is formed between the line head 1 and the lens array 31 within the head case 52. Since the line head 1 and the lens array 31 are air-tightly adhered to the head case 52 as mentioned above, the chamber 56 is air-tightly sealed. The chamber 56 is also filled with an inert gas, such as nitrogen gas, or is vacuumed.

Organic EL Element and Driving Element

Figure 7:
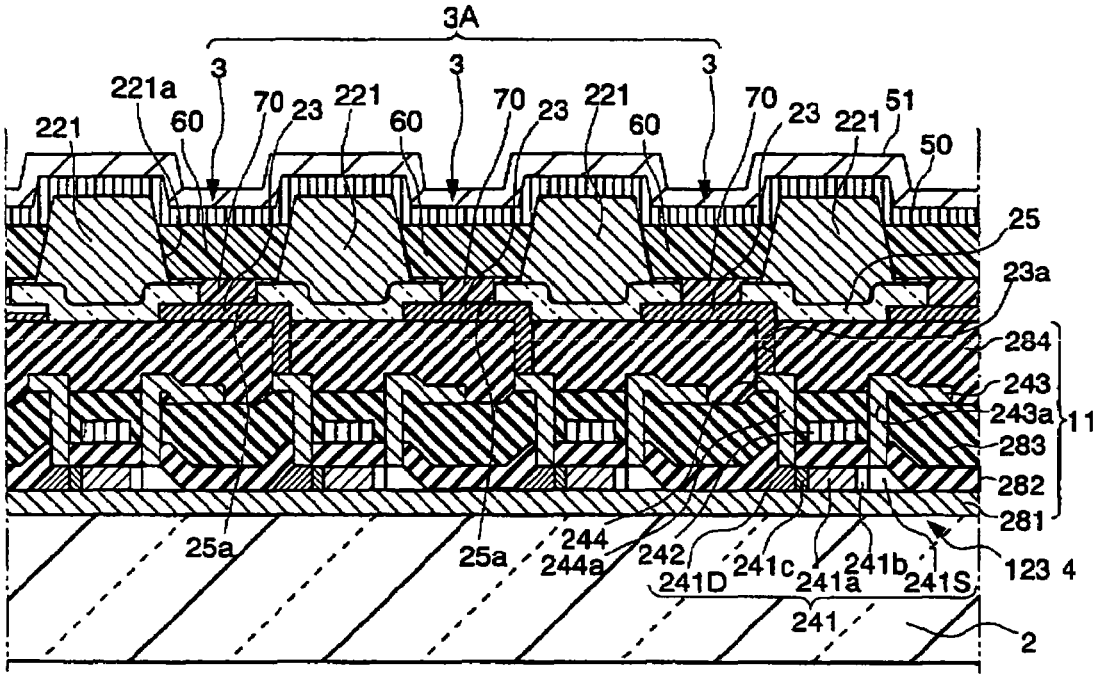
FIG. 7 is a literal sectional view of main parts of the line head.

The construction of the organic EL element, the driving element and so on in the line head 1 will now be described in detail with reference to FIG. 7.

In the case of a so-called bottom emission type in which light emitted from the light-emitting layer 60 is radiated from the pixel electrode 23, an element substrate 2 can be formed of a transparent or opaque material since the light is extracted from the element substrate 2. For example, the transparent or opaque material can include glass, quartz, a resin (plastic, plastic film) or the like. A glass substrate can be preferably used.

Furthermore, in the case of a so-called top emission type in which light emitted from the light-emitting layer 60 is radiated from the cathode (a counter electrode) 50, a transparent substrate or an opaque substrate can be used since the light is extracted from a sealing substrate which faces the element substrate 2). The opaque substrate can be formed of a thermosetting resin, a thermoplastic resin or the like other than a material in which insulation process such as surface oxidization is performed on ceramics, such as alumina, a metal sheet such as stainless steel or the like.

In the present embodiment, since the bottom emission type has been used, a transparent glass is used for the element substrate 2.

On the element substrate 2, a circuit part 11 having a driving TFT 123 (the driving element 4), etc. to be connected to a pixel electrode 23 is formed. The organic EL elements 3 are formed on the circuit part 11. Each of the organic EL elements 3 includes the pixel electrode 23 functioning as an anode, a hole transport layer 70 that injects or transports holes from the pixel electrode 23, a light-emitting layer 60 made of an organic EL material, and the cathode 50, which are sequentially formed. Under this construction, as a current flows through the functional layer having the hole transport layer 70 and the light-emitting layer 60, holes injected from the hole transport layer 70 and electrons from the cathode 50 are combined in the light-emitting layer 60 to emit light.

In the present embodiment of the bottom emission type, the pixel electrode 23 serving as the anode is formed of a transparent conductive material. To be more specific, ITO can be used as the material of the pixel electrode 23.

A material for forming the hole transport layer 70 can include a dispersion liquid of 3,4-polyethylenedioxythiophene/polystyrene sulfonic acid (PEDOT/PSS), preferably, a dispersion liquid where 3,4-polyethylenedioxythiophene is dispersed in polystyrene sulfonic acid (PEDOT/PSS) as a dispersion medium and the resultant is dispersed in water.

In addition, the material for forming the hole transport layer 70 is not limited to the above material, but can include various materials. For example, what polystyrene, polypyrrole, polyaniline, polyacetylene or derivatives thereof, etc., are dispersed in a proper dispersion medium such as polystyrene sulfonic acid can be used.

A material for forming the light-emitting layer 60 can include a known light-emitting material which can generate fluorescence or phosphorescence. In addition, in the present embodiment a light-emitting layer whose light-emitting wavelength band corresponds to red can be used. A light-emitting layer whose light-emitting wavelength band corresponds to green or blue can also be used. In this case, a photo conductor to be used includes a material which can have sensitivity in the light-emitting region.

A material for forming the light-emitting layer 60 preferably includes (poly)fluorene derivatives (PF), (poly)paraphenylenevinylene derivatives (PPV), polyphenylene derivatives (PP), polyparaphenylene derivatives (PPP), poly(vinyl carbazole) (PVK), polythiophene derivatives, polysilane base such as polymethylphenylsilane (PMPS) or the like. Furthermore, a low molecular material, such as perylene-based pigment, coumarin-based pigment, rhodamine-based pigment, rubrene, perylene, 9,10-diphenylanthracene, tetraphenylbutadiene, nailered, coumarin 6, quinacridone or the like, can be doped in the above high molecular material.

The cathode 50 covers the light-emitting layer 60 and is formed of Ca to have a thickness of about 20 nm. Al having a thickness of 200 nm is then formed on the cathode 50, thereby forming an electrode of a laminated structure. Al functions as a reflection layer.

The sealing substrate (not shown) is also adhered onto the cathode 50 by an adhesive layer.

Furthermore, the circuit part 11 is disposed below the organic EL elements 3 as mentioned above. The circuit part 11 is formed on the element substrate 2. That is, a base protecting layer 281, which has $SiO_2$ as a main constituent, is formed on the element substrate 2. A silicon layer 241 is formed on the base protecting layer 281. A gate insulating layer 282, which has $SiO_2$ and/or SiN as main constituents, is formed on the silicon layer 241.

Furthermore, a region where the silicon layer 241 overlaps a gate electrode 242 with the gate insulating layer 282 interposed therebetween is a channel region 241*a*. In addition, the gate electrode 242 is a part of the scanning line (not shown). Meanwhile, a first interlayer-insulating layer 283, which has $SiO_2$ as a main constituent, is formed on the gate insulating layer 282 which covers the silicon layer 241 and has the gate electrode 242 formed thereon.

Furthermore, a lightly doped source region 241*b* and a heavily doped source region 241S are disposed on the source side of the channel region 241*a* of the silicon layer 241, and a lightly doped drain region 241*c* and a heavily doped drain region 241D are disposed on the drain side of the channel region 241*a* of the silicon layer 241 to form a so-called Lightly Doped Drain (LDD) structure. The heavily doped source region 241S of the four regions is connected to a source electrode 243 through a contact hole 243*a* that is opened through the gate insulating layer 282 and the first interlayer-insulating layer 283. The source electrode 243 forms a part of the power supply line (not shown). Meanwhile, the heavily doped drain region 241D is connected to a drain electrode 244, which is formed on the same layer as the source electrode 243, through a contact hole 244*a* that is opened through the gate insulating layer 282 and the first interlayer-insulating layer 283.

A planarizing film 284, which has an acrylic-based resin component as a main constituent, is formed on the first interlayer-insulating layer 283 on which the source electrode 243 and the drain electrode 244 are formed. The planarizing film 284 is formed of a heat-resisting and insulating resin such as an acrylic base resin or a polyimide base resin. The planarizing film 284 is a known one used in order to remove irregularities on the surface which are formed due to the driving TFT 123 (the driving element 4), the source electrode 243, the drain electrode 244 and so on.

In addition, the pixel electrode 23 formed of ITO, etc. is formed on the planarizing film 284, and is connected to the drain electrode 244 through the contact hole 244*a* provided on the planarizing film 284. That is, the pixel electrode 23 is connected to the heavily doped drain region 241D of the silicon layer 241 via the drain electrode 244.

The pixel electrode 23 and the above-mentioned inorganic barrier ribs 25 are formed on the planarizing film 284 having the pixel electrode 23 formed thereon. Furthermore, the organic barrier ribs 221 are formed on the inorganic barrier ribs 25. In addition, the hole transport layer 70 and the light-emitting layer 60 are sequentially laminated on the pixel electrode 23 in this order from the pixel electrode 23, in openings 25*a* formed in the inorganic barrier ribs 25 and openings 221*a* formed in the organic barrier ribs 221, i.e., in a pixel region, thereby forming a functional layer.

The inorganic barrier ribs 25 is thin so that light can pass therethrough. Therefore, in accordance with the invention, the area of a light-emitting pixel of the organic EL elements 3 is decided by the openings 221*a* of the organic barrier ribs 221. As a result, when the organic barrier ribs 221 are patterned by lithography technology, etc., the organic barrier ribs 221 have the shape, the area and the location, which are previously set in each of the EL element columns 3A, 3B, as mentioned above. Therefore, the organic EL elements 3, which have the area as expressed by Equation 1 at a predetermined location, can be formed. In addition, in the case where the film thickness of the inorganic barrier ribs 25 is relatively large in order for light not to pass through it, the organic EL elements 3 having the area as expressed by Equation 1 can be formed by suitably patterning the openings 25*a* of the inorganic barrier ribs 25.

The usage pattern of the exposure apparatus 100 constructed as described above will be described as follows.

The line head module 101 constructed as described above forms images by radiating light onto the photosensitive drum 9 (i.e., a subject part to be exposed) as shown in FIG. 1 to perform exposure. The line head 1 and the lens array 31 are aligned with each other to be integrally supported by the head case 52. Due to this structure, only the line head module 101 can be aligned on the photosensitive drum 9 when using it.

Therefore, in the exposure apparatus 100 having the line head module 101, the photosensitive drum 9 can be easily aligned as compared with a case where the line head 1 and the lens array 31 are separately prepared. Furthermore, irregular exposure caused by poor alignment can be surely prevented.

An exposure method using the exposure apparatus 100 will now be described.

The exposure apparatus 100 performs exposure on the photosensitive drum 9 by scanning the EL element columns 3A of the group A and the EL element columns 3B of the group B in the line head 1 in a time-division manner. Furthermore, the line scanning order in the group A and the group B is the same only if they have the same column number.

Figure 8:
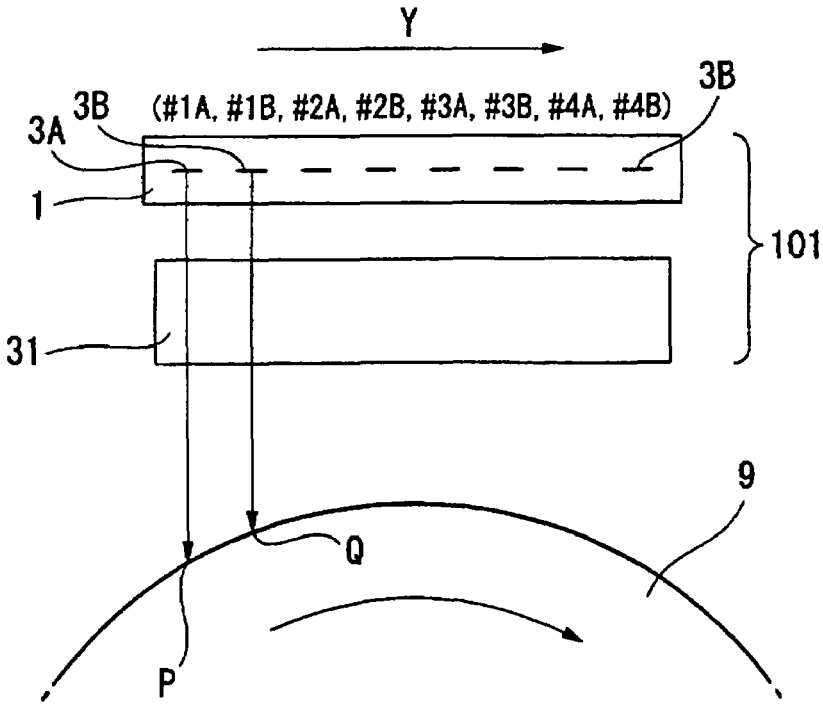
FIG. 8 is a view illustrating an exposure method of an exposure apparatus.

In the case of exposure, one or more of four organic EL elements 3 forming a group, in the EL element columns 3A (3B) of each group, is selected and then perform exposure on the same unit drawing region of the photosensitive drum 9, thereby changing gray-scale levels which indicate the degree of exposure. For example, as shown in FIG. 8, after exposure is performed on a unit drawing region P from a unit pixel (the organic EL element 3) of an EL element column #1A, i.e., a first column in the group A and exposure is also performed on a unit drawing region Q from a unit pixel of an EL element column #1B, i.e., a first column in the group B, when the photosensitive drum 9 rotates and relatively moves with respect to the line head 1 in the Y-axis direction, multiple exposure can be performed on the drawing point P in the order of a unit pixel of an EL element column #2A, i.e., a second column, a unit pixel of an EL element column #3A, i.e., a third column and a unit pixel of an EL element column #4A, i.e., a fourth column. As a result, in the present embodiment, a maximum of four multiple exposures can be performed. In the same way, a maximum of four multiple exposures can also be performed on the drawing point Q.

Figure 9A:
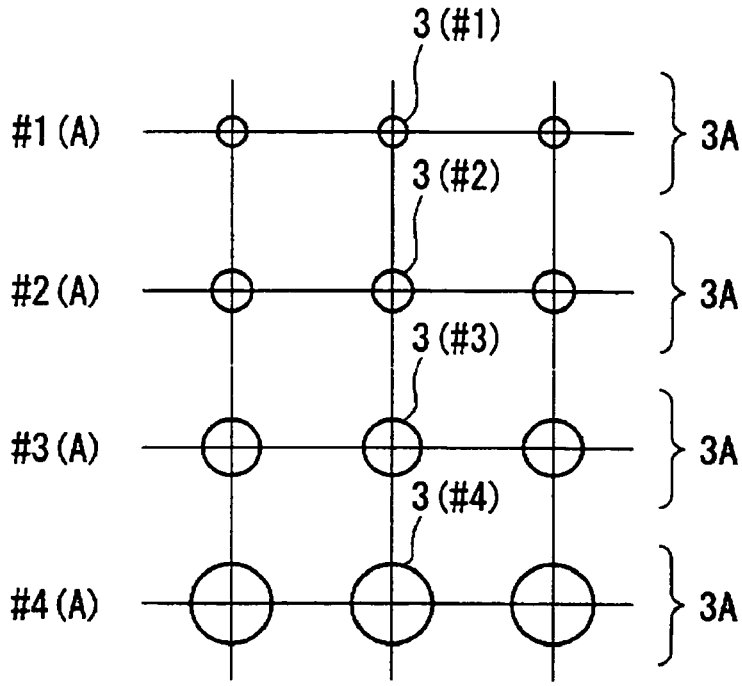
FIG. 9A diagrammatically shows an organic EL element.
Figure 9B:
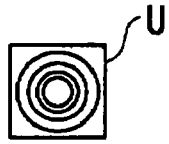
FIG. 9B is a view for illustrating multiple exposure.

As shown in FIG. 9A, in the EL element columns 3A whose column numbers are #1A to #4A, the corresponding four organic EL elements 3(#1), 3(#2), 3(#3) and 3(#4) will be examined. Each of the organic EL elements 3 has a constant luminance within a pixel and has a gray-scale level controlled according to a binary value of lighting and non-lighting as mentioned above. To be more specific, if exposure (lighting) is performed using the plurality of organic EL elements 3, the amount of exposure on the photosensitive drum 9 is the sum of the amounts of exposure by the respective organic EL elements 3. Therefore, if exposure is performed using all the selected four organic EL elements 3(#1), 3(#2), 3(#3) and 3(#4), quadruple exposure (multiple exposure) is performed in a concentric shape within the unit drawing region U on the photosensitive drum 9 as shown in FIG. 9B. In addition, a gray-scale level when the corresponding four organic EL elements 3(#1), 3(#2), 3(#3) and 3(#4) are all selected and perform exposure as described above is the highest gray-scale level in the present embodiment.

The photosensitive drum 9 is previously charged by a charging device (charging means) in the image forming apparatus to be described later. Furthermore, electricity on a surface of the photosensitive drum 9 that is uniformly charged is selectively removed by the exposure of the line head 1, to form an electrostatic latent image. The electrostatic latent image is developed by the toner supplied from the developing device. The toner image is transferred onto the paper by the transfer device, so that printing is performed.

Figure 10:
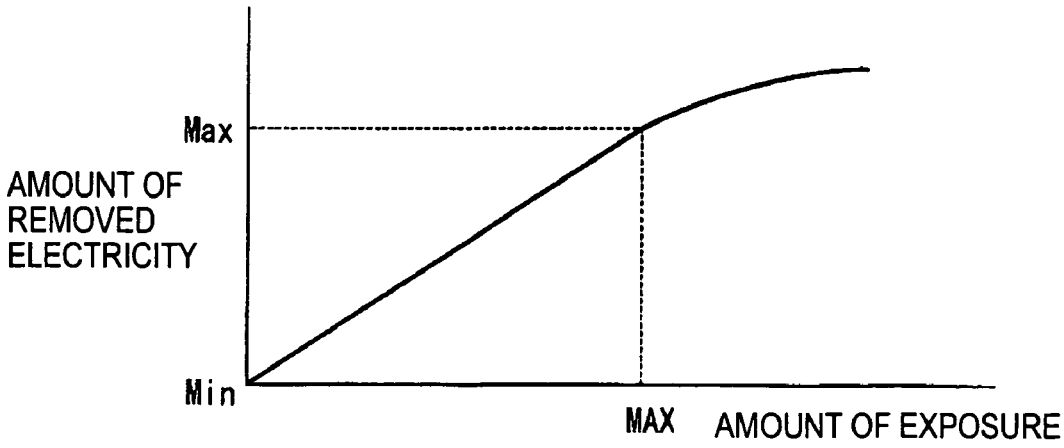
FIG. 10 is a graph showing the relationship between the exposure amount and the amount of removed electricity, of a photosensitive drum.

The amount of electricity removed from the charged photosensitive drum 9 is decided by the exposure amount, i.e., the sum of the amounts of exposure by the respective organic EL elements 3. Furthermore, the amount of removed electricity with respect to the exposure amount can vary depending on the charging amount for the photosensitive drum 9, etc. If the sum of the amounts of exposure by the respective organic EL elements 3 and the charging amount for the photosensitive drum 9 are previously adjusted, the amount of removed electricity can be basically decided by the sensitivity of the photosensitive drum 9. That is, the sensitivity of the photosensitive drum 9 can be expressed by the relation between the exposure amount and the amount of removed electricity as shown in FIG. 10. Referring to FIG. 10, it can be seen that the sensitivity of the photosensitive drum 9 in the present embodiment has the linearity between the lowest gray-scale level (Min) and the highest gray-scale level (Max).

In the present embodiment, in a range where the sensitivity of the photosensitive drum 9 has the linearity, the area S of a light-emitting pixel of the organic EL element 3 required to obtain the light amount (the exposure amount) with the value which is obtained by dividing the light amount (the exposure amount MAX) required to obtain the highest gray-scale level (Max) by $(2^N-1)$ (where, N is 4 (i.e., the number of EL element columns)), i.e., 15 (i.e., 2 to the 4th power−1), is set to $S_1$.

As described above, in the present embodiment, by properly selecting four organic EL elements 3 (#1), 3 (#2), 3 (#3) and 3 (#4), the sum of a pixel area of the selected organic EL elements 3 can become equidistant (equal difference). Therefore, exposure of 16 gray-scale levels, including the lowest gray-scale level when all the four organic EL elements 3 are not selected (not lighted), can be performed. In addition, in a gray-scale level range, since the photosensitive drum 9 has the sensitivity with linearity as mentioned above, the electricities are removed according to the gray-scale level of exposure. As a result, printing can be performed according to the gray-scale level of exposure as mentioned above.

In the present embodiment, as shown in FIG. 9B, a maximum of quadruple multiple exposure can be performed within the unit drawing region U. Therefore, distribution of one to quadruple exposure can be formed for the exposure portion in a radial direction. However, the photosensitive drum 9 of the present embodiment has a predetermined sensitivity as mentioned above such that the sum of the exposure amount is sufficiently proportional to the amount of removed electricity up to the quadruple exposure. In addition, since the unit drawing region U is very fine, it is impossible to view irregular exposure within the unit drawing region U with the naked eyes. Due to this, actual printing can be displayed depending on the set gray-scale level without irregularity.

Furthermore, in the present embodiment, exposure is also performed by the organic EL elements 3 of the group B as well as the exposure using the organic EL elements 3 of the group A as mentioned above. This can improve the print resolution. That is, by allowing the EL element columns 3A, 3B having the same column number to alternately perform exposure on the same unit drawing region column, between the unit drawing region U exposed by the organic EL elements 3 of the group A can be filled with the unit drawing region U exposed by the organic EL elements 3 of the group B. Therefore, since exposure is performed with a small distance between the organic EL elements 3, resolution can be improved.

In this exposure apparatus 100, since exposure is performed with a light-emitting area being changed in equal distance (equal difference) gray-scale level representation which indicates the degree of exposure can be performed easily and excellently.

Furthermore, since gray-scale level of each organic EL element 3 is controlled according to a binary value of lighting and non-lighting as mentioned above, the overall gray-scale level is easily displayed and a clock frequency necessary for every line (one EL element column) is lowered. Therefore, a driver for driving each EL element can be built in the substrate. In addition, since the built-in driver can be employed as described above, the cost can be significantly reduced, and the degree of freedom in manufacturing the line head 1 and the degree of freedom in terms of the structure of an exposure apparatus or an image forming apparatus having such a driver can also be improved as compared with a case of a driver for external mounting.

Furthermore, even though sufficient luminance (the amount of light) is not obtained with only one organic EL element 3, a sufficient light amount (the exposure amount) can be obtained in such a manner that a plurality of organic EL elements 3 perform exposure on the same unit drawing region. Therefore, it does not need to flow a high current so as to obtain sufficient luminance using only one organic EL element 3. It is thus possible to prevent the shortening of the lifespan of the organic EL elements 3 due to the high current, as described above.

Furthermore, since each EL element between the EL element columns has a constant luminance within a pixel among each of the EL elements, the lifespan of the EL element columns becomes almost the same. Therefore, the lifespan of the line head can be prevented from significantly reducing from its original lifespan, which is because the lifespan of the line head becomes the same as the lifespan of an EL element column having the shortest lifespan due to variations in the lifespan of EL element columns.

In addition, deviation exists in luminance among the pixels consisting of the organic EL elements 3. For example, even though an organic EL element 3 having the lowest luminance exists due to such deviation, there is no possibility that the only organic EL element 3 having a low luminance will perform exposure on a plurality of drawing points because a plurality of organic EL elements 3 performs exposure on the same unit drawing region. As a result, poor printing that can be incurred by an organic EL element 3 having a low luminance can be prevented.

In addition, the invention is not limited to the above embodiment, but can be modified in various ways without departing from the scope and spirit of the invention. For example, in the above-described embodiment, it has been described that the group A and the group B have four numbers of organic EL element columns, respectively. However, the number of the organic EL element columns can be 2, 3 or, 5 or higher depending on the highest gray-scale level that is needed. If the number of the organic EL element columns is 2 or 3, the value of gray-scale levels is reduced, which in turn results in a reduced lifespan of the head. However, since the number of drivers is reduced, the cost for the drivers themselves can be reduced. Meanwhile, if the number of organic EL element columns is 5 or higher, the value of gray-scale levels can be increased according to the power of two whenever one organic EL element column is increased. Therefore, the lifespan of the head can be lengthened by the increase of the organic EL element columns. For example, if the number of organic EL element columns is 5, 32 gray-scale levels can be obtained as 2 to the 5th power, as the highest gray-scale level.

Furthermore, in the above-described embodiment, as shown in FIG. 3, the organic EL element columns 3A, 3B are disposed in ascending order of the area so that the disposition order and the column number are identical to each other. In the invention, however, the column number refers to a symbol indicating only the area without regard to the disposition order. Therefore, in the disposition order, organic EL element columns can be randomly disposed on the line head without regard to the area. In addition, the disposition order can be random in the organic EL element columns 3A and 3B.

Furthermore, in the above embodiment, each of the organic EL element columns which has two types of the group A and the group B is disposed in a zigzag pattern so as to increase resolution. However, resolution can be further improved by increasing the organic EL element columns that perform exposure on the same unit drawing region column to three types or more. In addition, if organic EL element columns have a group, the number of drivers can be reduced, which further reduces the cost for extra drivers.

Figure 11A:
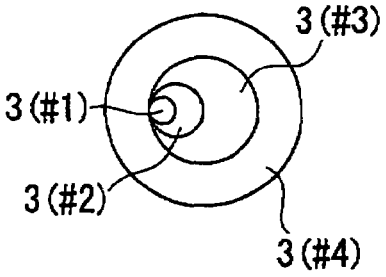
FIGS. 11A to 11C are views illustrating multiple exposure.

Furthermore, in the above-mentioned embodiment, it has been described that a group consisting of the corresponding four organic EL elements 3 in the group A or the group B, on the line head 1, is quadruply disposed in a concentric shape within the unit drawing region U on the photosensitive drum 9 so that a quadruple exposure can be partially performed, as shown in FIG. 9B. However, the center of the disposition of the group on the line head 1 can be deviated as shown in FIG. 11A.

Figure 11B:
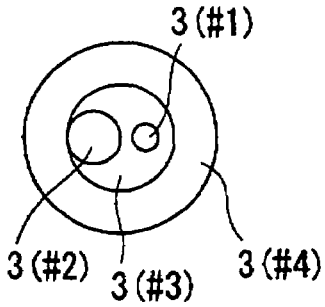
Figure 11C:
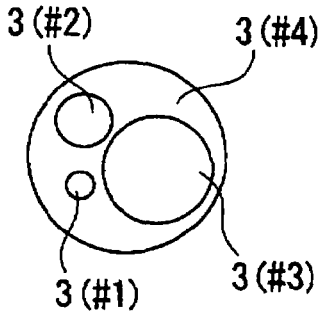

Furthermore, in the case where the sum of the exposure amount at multiple exposure points is not proportional to the amount of removed electricity, i.e., is in a region in which linearity is lost in FIG. 10 because the sensitivity of the photosensitive drum cannot depend on multiple exposure, and the linearity cannot be obtained, the maximum overlapping exposure can become triple exposure, as shown in FIG. 11B. Furthermore, the maximum overlapping exposure can become a dual exposure, as shown in FIG. 1C.

Figure 12A:
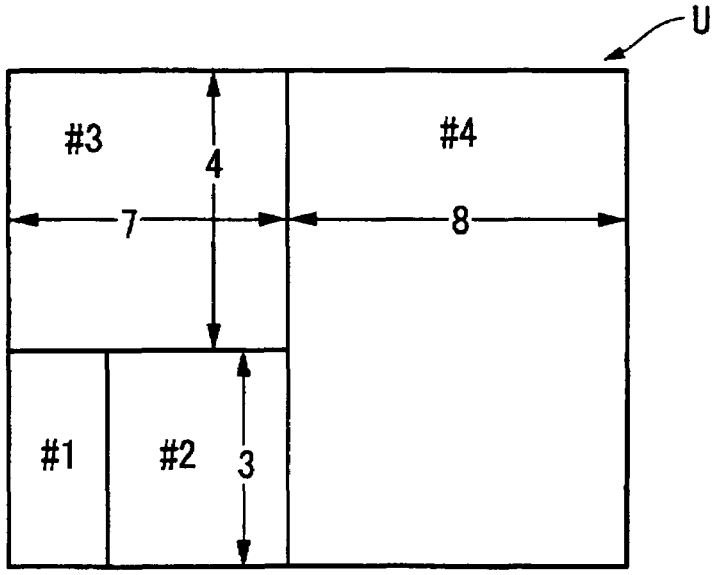
FIGS. 12A and 12B are views illustrating a case where overlapping exposure is not performed.

Furthermore, to obtain a high sensitivity for the photosensitive drum, overlapping exposure (multiple exposure) may not be performed on the unit drawing region U, as shown in FIG. 12A. FIG. 12A shows an example of a case where the number of organic EL element columns of each group is 4 and the number of the corresponding organic EL elements 3 is 4, in the same manner as the above embodiment. In FIG. 12A, #1 to #4 indicate exposure points of each organic EL element 3 on the photosensitive drum and also indicates the disposition of light-emitting pixels of each organic EL element 3 on the line head. In this example, if the unit drawing region U (i.e., a subject part to be exposed) is approximately square, the area ratio of the subject part to be exposed is divided into 7:8 as shown in FIG. 12. Furthermore, the organic EL elements #1 to #4, which are on the exposure side, are disposed such that a '7' side is divided into 4:3 and then a '3' side divided into 2:1. By doing so, at the time of the highest gray-scale level, the entire unit drawing region U can be uniformly exposed without overlapping exposure in the unit drawing region U.

Figure 12B:
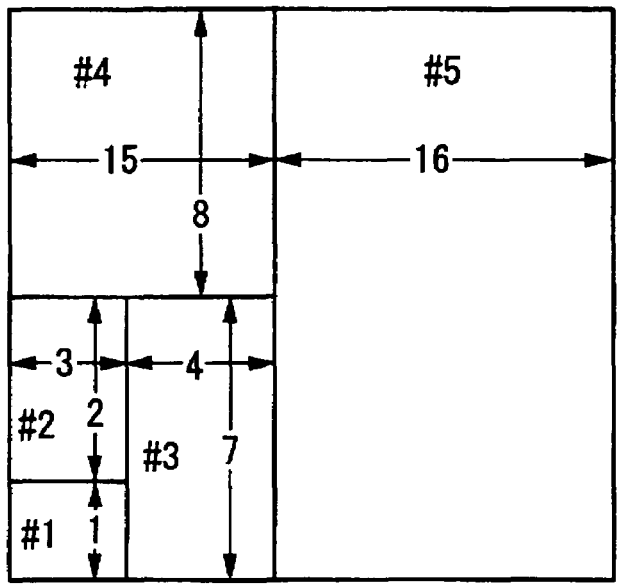

FIG. 12B shows an example of a case where the number of organic EL element columns of each group is five and the number of the corresponding organic EL elements 3 is five, and 32 gray-scale levels are displayed. In FIG. 12B, #1 to #5 indicate exposure points of each organic EL element 3 on the photosensitive drum and also indicates the disposition of light-emitting pixels of each organic EL element 3 on the line head. Even in this example, if the unit drawing region U (i.e., a subject part to be exposed) is approximately square, the organic EL elements #1 to #5, which are on the exposure side, are disposed such that the area ratio of the subject part to be exposed is divided, as shown in FIG. 12B. By doing so, the entire unit drawing region U can be uniformly exposed without overlapping exposure in the unit drawing region U.

Embodiments

Embodiments of the exposure apparatus having the line head 1 shown in FIG. 3 will be described below.

In the exposure apparatus of the present embodiment, a line image with 600 dots/inch can be drawn (exposed). Both the group A and the group B include the organic EL elements 3 of 300 dots/inch, i.e., 300 organic EL elements 3/inch in the X-axis direction of FIG. 3. The organic EL elements 3 form each of the organic EL element columns 3A, 3B.

In addition, exposure is performed by scanning and lighting the four organic EL element columns 3A, 3B, each having the area ratio as describe above, in the order of #1, #2, #3 and #4 along the Y-axis direction of FIG. 3 which is a paper feed direction (a rotational direction of the photosensitive drum 9).

The sensitivity of a typical photosensitive drum is constructed to obtain the linearity whose exposure amount is up to about 0.2 $\mu J/cm^2$. Therefore, the maximum value capable of obtaining the linearity is set to the highest exposure amount. In the example shown in FIG. 3, the sum of the areas of the organic EL elements #1, #2, #3 and #4 is set to $15 \times S_1$. Therefore, since, by dividing 0.2 $\mu J/cm^2$ by 15, $S_1$=0.0133 $J/cm^2$, the organic EL element #1 emits light so as to obtain a power (luminance) of 0.0133 $J/cm^2$ is obtained. In a similar way, the organic EL element #2 emits light so as to obtain a power (luminance) of 0.0267 $J/cm^2$, the organic EL element #3 emits light so as to obtain a power (luminance) of 0.0533 $J/cm^2$, and the organic EL element #4 emits light so as to obtain a power (luminance) of 0.1067 $J/cm^2$. Through this construction, the highest gray-scale level when all the four organic EL elements 3 perform exposure becomes the highest exposure amount. As a result, the photosensitive drum has the sensitivity with linearity from the lowest gray-scale level to the highest gray-scale level (the highest exposure amount).

If exposure is performed by this exposure apparatus, gray-scale level can be easily displayed in total and a clock frequency necessary for every line (one EL element column) can be lowered because a gray-scale level of the organic EL element 3 have a binary value of lighting and non-lighting in a scanning signal of the X-axis direction. For instance, when the printing speed is 40 ppm, 1.5 second is taken per one sheet of printing. If A4 size paper is printed vertically, 7100 lines are drawn. Therefore, a time taken to scan one line is $2.1 \times 10^{-4}$ seconds (210 μs). In the case of binary display (binary gray-scale level), a clock frequency can be 4.76 kHz (a data frequency 2.4 kHz). Therefore, when compared with the high frequency driving per one head line in the related art, the clock frequency can be significantly decreased. As a result, an internally-mounted TFT as a driver, which is integrally formed on the substrate having the organic EL elements 3 formed thereon, can be used as the driving element.

An image forming apparatus in which the exposure apparatus of the invention is included as an exposure unit will now be described.

Tandem Image Forming Apparatus

Figure 13:
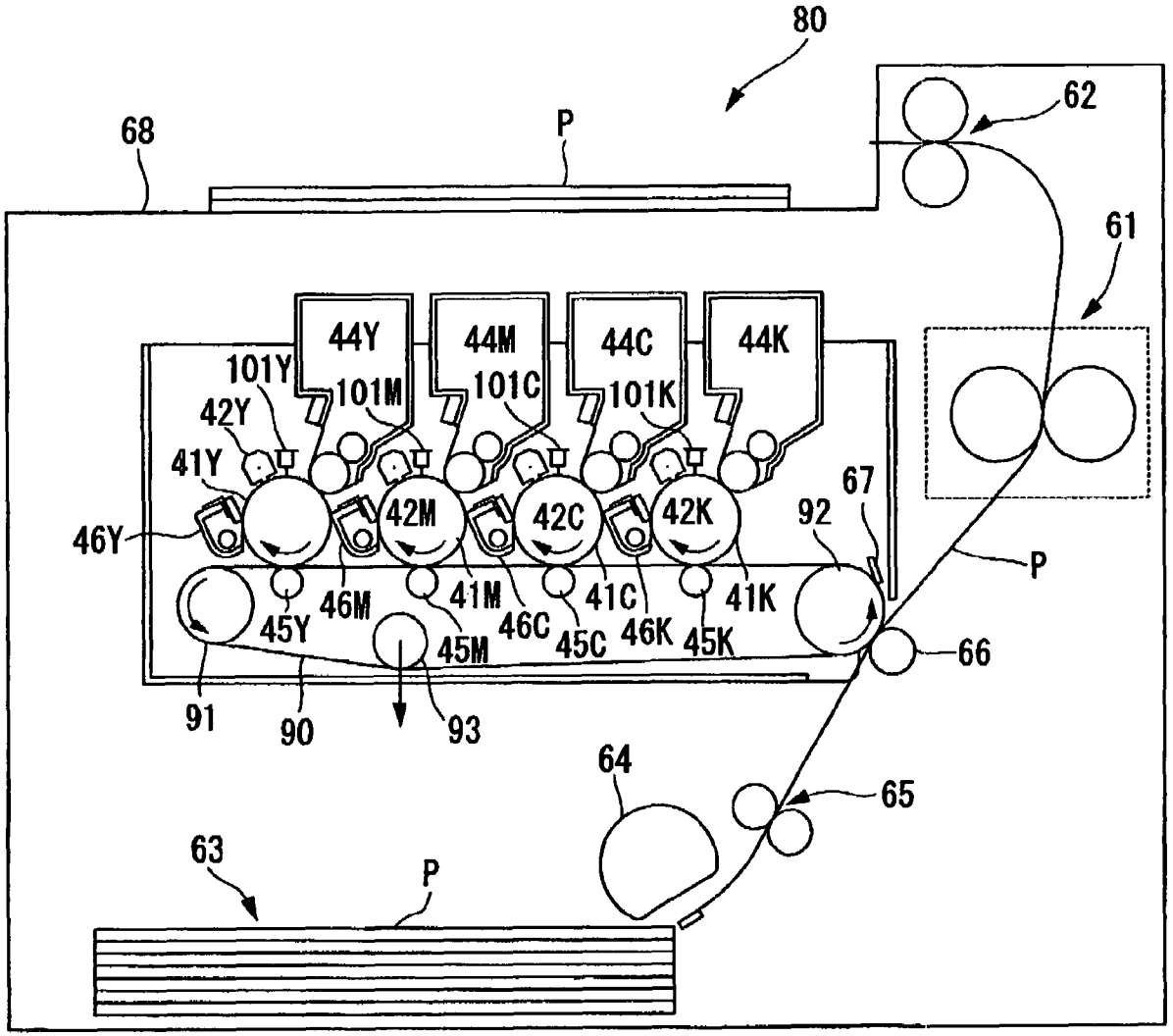
FIG. 13 schematically shows the construction of an image forming apparatus according to a first embodiment of the invention.

FIG. 13 schematically shows the construction of an image forming apparatus according to a first embodiment of the invention. In FIG. 13, reference numeral 80 indicates a tandem image forming apparatus. The image forming apparatus 80 has a tandem system in which organic EL array line heads 101K, 101C, 101M and 101Y are disposed in four photosensitive drums 41K, 41C, 41M and 41Y, which have the same construction, respectively to form an exposure apparatus.

The image forming apparatus 80 includes a driving roller 91, a driven roller 92, and a tension roller 93. An intermediate transfer belt 90 is hung on the rollers so as to circulate in the arrow direction (a counterclockwise direction) of FIG. 13. The photosensitive drums 41K, 41C, 41M and 41Y are disposed on the intermediate transfer belt 90 at a predetermine distance. These photosensitive drums 41K, 41C, 41M and 41Y have outer circumferences which becomes a photoresist layer serving as an image carrier.

The letters K, C, M and Y represent colors, black, cyan, magenta and yellow, respectively, and indicate black, cyan, magenta and yellow photosensitive materials, respectively. In addition, the meaning of the letters K, C, M, Y is applied to other members in the same manner. The photosensitive drums 41K, 41C, 41M and 41Y are adapted to rotate in the arrow direction (a clockwise direction) of FIG. 13 in synchronization with the driving of the intermediate transfer belt 90.

Charging means (a corona charging unit) 42K, 42C, 42M, 42Y for uniformly charging the outer circumferences of the photosensitive drums 41K, 41C, 41M, 41Y, respectively, and organic EL array line heads 101K, 101C, 101M, 101Y for sequentially line-scanning the outer circumferences of the charging means 42K, 42C, 42M, 42Y, which have been uniformly charged, in synchronization with the rotation of the photosensitive drums 41K, 41C, 41M, 41Y, are provided around the photosensitive drums 41K, 41C, 41M, 41Y, respectively.

The organic EL array line heads 101K, 101C, 101M, 101Y are aligned with the SL array (not shown) to be integrally supplied by the head case as mentioned above, which are used as the line head module.

The image forming apparatus 80 further includes developing devices 44K, 44C, 44M, 44Y that convert an electrostatic latent image, which is formed by the organic EL array line heads 101K, 101C , 101M, 101Y (the line head modules), into a visible image (a toner image) by applying the toner (i.e., a developer) to the electrostatic latent image, primary transfer rollers 45K, 45C, 45M, 45Y serving as first transfer means, that sequentially transfer the toner image formed by the developing devices 44K, 44C, 44M, 44Y onto the intermediate transfer belt 90 (i.e., a primary transfer subject), and cleaning devices 46K, 46C, 46M, 46Y, serving as cleaning means, that remove the toner remaining on the surfaces of the photosensitive drums 41K, 41C, 41M, 41Y after transferring.

The organic EL array line heads 101K, 101C, 101M, 101Y are disposed such that their array directions follow the bus line of the photosensitive drums 41K, 41C, 41M, 41Y. Furthermore, a light-emitting energy peak wavelength of each of the organic EL array line heads 101K, 101C, 101M, 101Y is set to approximately coincide with a sensitivity peak wavelength of each of the photosensitive drums 41K, 41C, 41M, 41Y.

The developing devices 44K, 44C, 44M, 44Y use non-magnetic one component toner as the developer. In the developing devices 44K, 44C, 44M, 44Y, a supply roller, etc. conveys the one component developer to the developing roller to regulate a film thickness of the developer adhered on the surface of the developing roller by using a regulation blade. The developing roller is then brought in contact with or to be pressurized onto the photosensitive drums 41K, 41C, 41M, 41Y to adhere the developer according to a voltage level of the photosensitive drums 41K, 41C, 41M, 41Y, thereby developing as a toner image.

The black, cyan, magenta and yellow toner images formed by the four monochrome toner image formation stations are sequentially transferred onto the intermediate transfer belt 90 according to a primary transfer bias applied to the primary transfer rollers 45K, 45C, 45M, 45Y. The toner images, which have sequentially overlapped on the intermediate transfer belt 90 to be full color images, are secondly transferred onto a recording medium P such as a paper in a secondary transfer roller 66. The toner images pass through a pair of fixing rollers 61 (i.e., a fixing part) and are fixed on the recording medium P. The paper is then ejected onto a paper ejecting tray 68 formed on the image forming apparatus 80 by means of a pair of paper ejecting rollers 62.

In addition, reference numeral 63 in FIG. 13 indicates a paper feed cassette in which several sheets of the recording media P are laminated. Reference numeral 64 indicates a pick-up roller that feeds the recording medium P one by one from the paper feed cassette 63. Reference numeral 65 indicates a pair of gate rollers that defines a timing for supplying the recording medium P to a secondary transfer part of a secondary transfer roller 66. Reference numeral 66 indicates the secondary transfer roller as secondary transfer means, which constitutes the secondary transfer part between the secondary transfer roller 66 and the intermediate transfer belt 90. Reference numeral 67 indicates a cleaning blade as cleaning means, for removing the toner remaining on the surface of the intermediate transfer belt 90 after secondary transfer.

4 Cycle Type Image Forming Apparatus

Figure 14:
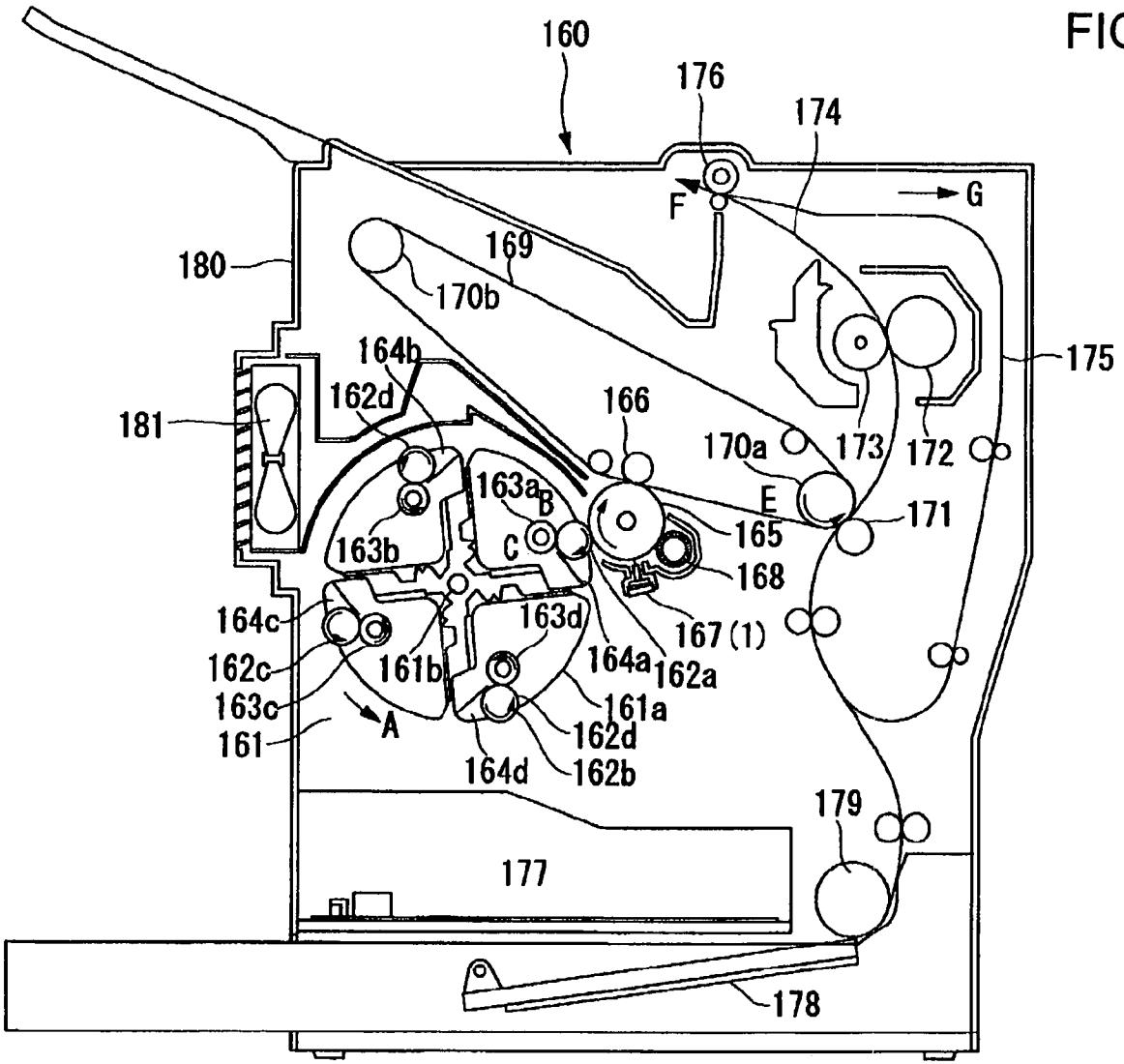
FIG. 14 schematically shows the construction of an image forming apparatus according to a second embodiment of the invention.

An image forming apparatus according to a second embodiment of the invention will be described below. FIG. 14 is a longitudinal sectional side view of the image forming apparatus of a 4 cycle method. In FIG. 14, an image forming apparatus 160 includes a rotary developing device 161, a photosensitive drum 165 serving as an image carrier, image recording means 167 configured by a line head module, an intermediate transfer belt 169, a paper conveyance path 174, a heating roller 172 of a fixing unit, and a paper feed tray 178.

In the developing device 161, a developing rotary 161*a* is constructed to rotate around a shaft 161*b* in the direction of the arrow A. The interior of the developing rotary 161*a* is divided into four sections. Four image forming units of yellow (Y), cyan (C), magenta (M) and black (K) are provided in the four sections, respectively. Reference numerals 162*a* to 162*d* indicate developing rollers disposed in the four-color image forming units, respectively, and rotate in the direction of the arrow B. Reference numerals 163*a* to 163*d* indicates toner supply rollers that rotate in the direction of the arrow C. Furthermore, reference numerals 164*a* to 164*d* indicate regulating blades that regulate the toner to have a predetermined thickness.

Reference numeral 165 in FIG. 14 indicates a photosensitive drum serving as an image carrier, as described above. Reference numeral 166 indicates a primary transfer member, reference numeral 168 indicates a charging unit and reference numeral 167 indicates image recording means having a line head module. In addition, an exposure apparatus of the invention includes the photosensitive drum 165 and the image recording means (the line head module) 167.

The photosensitive drum 165 is constructed to rotate in the direction of the arrow D, which is the reverse direction to the developing roller 162*a*, by means of a driving motor (not shown) such as a step motor. In addition, the line head module constituting the image recording means 167 is disposed so as to be aligned with the photosensitive drum 165 (with respect to an optical axis).

The intermediate transfer belt 169 is hung between a driving roller 170*a* and a driven roller 170*b*. The driving roller 170*a* is connected to a driving motor of the photosensitive drum 165 to transmit power to the intermediate transfer belt 169. That is, if the driving motor is driven, the driving roller 170*a* of the intermediate transfer belt 169 rotates in the direction of the arrow E, which is the reverse direction to the photosensitive drum 165.

In the paper conveyance path 174, a plurality of conveyance rollers, a pair of paper ejecting rollers 176 and the like are provided. The paper conveyance path 174 functions to convey paper. An image (a toner image) on one side of paper, which is carried in the intermediate transfer belt 169, is transferred onto the other side of the paper at a location of the secondary transfer roller 171. The secondary transfer roller 171 is separated from or brought in contact with the intermediate transfer belt 169 through a clutch. When the clutch is turned on, the secondary transfer roller 171 is brought in contact with the intermediate transfer belt 169 and transfers an image on the paper.

The paper on which the image has been transferred as described above undergoes a fixing process by a fixing device having a fixing heater H. A heating roller 172 and a pressure roller 173 are provided in the fixing device. The paper after the fixing process has been performed is pulled in the pair of paper ejecting rollers 176 and proceeds in the direction of the arrow F. If the pair of paper ejecting rollers 176 rotates in the reverse direction in this state, the paper has its direction reversed, which causes a double-sided printing conveyance path 175 to proceed in the direction of the arrow G. Reference numeral 177 indicates an electric component box, reference numeral 178 indicates a paper feed tray for containing the paper and reference numeral 179 indicates a pick-up roller provided at the outlet of the paper feed tray 178.

In the paper conveyance path, the driving motor that drives the conveyance roller can include a brushless motor having a low speed. Furthermore, since color shift correction, etc. is needed in the intermediate transfer belt 169, a step motor can be used. These motors are controlled according to a signal from control means (not shown).

If an electrostatic latent image is formed on the photosensitive drum 165 and a high voltage is applied to the developing roller 162*a*, in the state shown in FIG. 14, a yellow image is formed on the photosensitive drum 165. If yellow images on rear and front surfaces are carried in the intermediate transfer belt 169, the developing rotary 161*a* rotates by 90 degrees in the direction of the arrow A.

The intermediate transfer belt 169 rotates once and returns to the position of the photosensitive drum 165. Cyan (C) double-sided images are formed on the photosensitive drum 165 and then overlap the yellow image carried in the intermediate transfer belt 169. In the same way, a first process in which the developing rotary 161 rotates by 90 degrees and the image is carried in the intermediate transfer belt 169 is repeated.

In four color image carriage, the intermediate transfer belt 169 rotates four times and again has its rotation location controlled, thereby transferring the images on the paper at the location of the secondary transfer roller 171. The paper supplied from the paper feed tray 178 returns to the conveyance path 174, so that a color image is transferred on one side of the paper at the location of the secondary transfer roller 171. The paper with one side on which the image has been transferred is reversed by the pair of paper ejecting rollers 176 as described above, and then waits in the conveyance path. Thereafter, the paper returns to the location of the secondary transfer roller 171 at a suitable timing, so that the color image can be transferred on the other side of the paper. An exhaust fan 181 is provided in a housing 180.

The image forming apparatuses 80, 160 shown in FIGS. 13 and 14 include the exposure apparatus of the invention as shown in FIG. 1 as the exposure unit.

Therefore, in these image forming apparatuses 80, 160, gray-scale level can be easily and satisfactorily displayed as mentioned above. Furthermore, since the line head that is internally mounted on the substrate can be employed as a driver for driving each EL element, the degree of freedom in terms of the structure of the image forming apparatuses 80, 160 having the line head can be improved. Furthermore, since a line head (a line head module) capable of obtaining a necessary light amount is used, a sufficient degree of gray-scale levels can be obtained. Furthermore, since the line head has almost the same lifespan between respective EL element columns, the lifespan of the entire line head can be increased, and the shortening of the lifespan of the image forming apparatus itself, which is caused by the line head, can be prevented accordingly.

In addition, the image forming apparatus having the exposure apparatus of the invention is not limited to the embodiments, but can be modified in various manners.

What is claimed is:

1. An exposure apparatus comprising:

a line head in which a plurality of EL (electroluminescent) elements are aligned; and a rotatable photosensitive drum, which is exposed by light from the line head, wherein the line head includes N (where, "N" is 2 or greater) EL element columns in which the alignment direction of the EL elements is parallel to the rotational axis of the photosensitive drum, in each of the EL element columns, the area of a light-emitting pixel of the EL element which emits light is constant within a corresponding column, when the column number of the EL element columns is from 1 to N, the area S of the light-emitting pixel of the EL element in each of the columns is $S_i=S_1\times 2^{i-1}$ (where, "i" is the column number of each of the EL element columns and a natural number from 1 to N, and "$S_1$" is the area of the light-emitting pixel of the EL element of a first column), and one or a plurality of EL elements selected from N EL elements within the N EL element columns perform exposure on the same unit drawing region on the photosensitive drum, wherein the area S of the light-emitting pixel of the EL element, which is necessary to obtain the light amount with a value which is obtained by dividing the light amount necessary to obtain the highest gray-scale level in gray-scale levels indicating the degree of exposure for the unit drawing region of the photosensitive drum by ($2^{N-1}$) (where, "N" is the number of EL element columns), is set to $S_1$, wherein the each EL element column form a group A, and other EL element columns form a group B, which includes the same number of EL element columns as the group A, and in which each of the EL element columns has the same number of EL elements as each of the EL element columns of the group A and a relative location relation between the EL elements is the same as the group A, and wherein each EL element column of the group A is spaced from adjacent EL element columns of the group A by a pitch, the EL element columns of the group B being disposed from the EL element columns of group A at positions deviated by half of the pitch.

2. The exposure apparatus according to claim 1, wherein, when the same unit drawing region on the photosensitive drum is exposed by the EL element, gray-scale levels indicating the degree of exposure is varied depending on one of the N EL elements selected in order to perform the exposure.

3. The exposure apparatus according to claim 1, wherein each of the EL elements has a gray-scale level controlled according to a binary value of lighting and non-lighting.

4. The exposure apparatus according to claim 1, wherein each of the EL elements is driven by a driving element formed on the substrate having the EL element formed therein.

5. The exposure apparatus according to claim 1, wherein the photosensitive drum has the sensitivity having linearity between the lowest gray-scale level and the highest gray-scale level in gray-scale levels indicating the degree of exposure for the unit drawing region of the photosensitive drum.

6. The exposure apparatus according to claim 1, wherein the EL element columns of the group A and the EL element columns of the group B, which correspond to the EL element columns of the group A, are constructed to alternately perform exposure on the same unit drawing region column, and the EL element columns of the group A and the EL element column of the group B, which correspond to the EL element columns of the group, have the same light-emitting area of the light-emitting pixel, and also have the same line scanning sequence in each group.

7. The exposure apparatus according to claim 1, wherein corresponding N EL elements among the N EL element columns perform multiple exposure in which the same unit drawing region at least partially overlaps, and wherein corresponding N EL elements among the N EL element columns perform multiple exposures in the same unit drawing region, wherein a point in the same unit drawing region has been exposed less than N times, i.e., the number of EL element columns.

8. The exposure apparatus according to claim 1, wherein in the N EL elements among the N EL element columns, the regions that are exposed in the same unit drawing region do not overlap.

9. The exposure apparatus according to claim 1, wherein the EL elements are organic EL elements.

10. An image forming apparatus comprising an exposure apparatus according to claim 1 as an exposure unit.

* * * * *